US009096987B2

(12) United States Patent
Younan et al.

(10) Patent No.: US 9,096,987 B2
(45) Date of Patent: Aug. 4, 2015

(54) COMPLIANT DECK TOWER

(75) Inventors: Adel H. Younan, Sugar Land, TX (US); J. Ward Turner, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 49 days.

(21) Appl. No.: 13/699,918

(22) PCT Filed: May 9, 2011

(86) PCT No.: PCT/US2011/035712

§ 371 (c)(1), (2), (4) Date: Nov. 26, 2012

(87) PCT Pub. No.: WO2012/003044

PCT Pub. Date: Jan. 5, 2012

(65) Prior Publication Data

US 2013/0089379 A1 Apr. 11, 2013

Related U.S. Application Data

(60) Provisional application No. 61/359,923, filed on Jun. 30, 2010.

(51) Int. Cl.

| | |
|---|---|
| ***E02B 17/00*** | (2006.01) |
| ***E02D 31/08*** | (2006.01) |
| ***E02B 17/02*** | (2006.01) |
| ***E02D 29/09*** | (2006.01) |

(52) U.S. Cl.

CPC ..... *E02D 31/08* (2013.01); *E02B 17/0017* (2013.01); *E02B 17/027* (2013.01); *E02D 29/06* (2013.01); *E02B 2017/0086* (2013.01)

(58) Field of Classification Search

CPC ..... E02B 17/0017

USPC ..... 405/195.1, 201, 202, 203, 204, 211, 405/224

See application file for complete search history.

(56) References Cited

U.S. PATENT DOCUMENTS

| | | | | |
|---|---|---|---|---|
| 4,152,087 | A * | 5/1979 | Zaleski-Zamenhof et al. | 405/195.1 |
| 4,191,495 | A * | 3/1980 | Rivacoba et al. | 405/195.1 |
| 4,389,141 | A * | 6/1983 | Cumings | 405/201 |
| 4,474,508 | A * | 10/1984 | Vos et al. | 405/204 |
| 4,474,729 | A | 10/1984 | Schoening et al. | |
| 4,610,569 | A | 9/1986 | Finn et al. | |
| 4,696,601 | A | 9/1987 | Davenport | |

(Continued)

FOREIGN PATENT DOCUMENTS

| | | | | |
|---|---|---|---|---|
| JP | 62-165353 | | 7/1987 | |
| JP | 05009921 | A * | 1/1993 | E02B 17/00 |

(Continued)

OTHER PUBLICATIONS

Clarke, C.S.J., et al. (2005), "Structural platform Solution for Seismic Arctic Environments—Sakhalin II Offshore Facilities", *Proceedings of Offshore Technology Conference*, Houston, TX, OTC 17378.

(Continued)

*Primary Examiner* — Frederick L Lagman

(74) *Attorney, Agent, or Firm* — ExxonMobil Upstream Research—Law Department

(57) ABSTRACT

Compliant offshore platforms with isolated decks using one or more bearings located on a generally horizontal plane that is in proximity to the vertical center of gravity of the deck.

16 Claims, 6 Drawing Sheets

(56) References Cited

U.S. PATENT DOCUMENTS

| | | | |
|---|---|---|---|
| 4,696,603 | A | 9/1987 | Danaczko et al. |
| 4,696,604 | A | 9/1987 | Finn et al. |
| 4,717,288 | A | 1/1988 | Finn et al. |
| 4,810,135 | A | 3/1989 | Davenport |
| 5,553,977 | A | 9/1996 | Andersen et al. |
| 6,299,384 | B1 | 10/2001 | Glasscock et al. |
| 6,324,795 | B1 | 12/2001 | Stiles et al. |
| 6,325,566 | B1 | 12/2001 | Devine |
| 6,385,918 | B1 | 5/2002 | Robinson |
| 6,955,467 | B2 | 10/2005 | Chang et al. |
| 6,966,154 | B1 | 11/2005 | Bierwirth |
| 6,971,795 | B2 | 12/2005 | Lee et al. |
| 7,270,186 | B2 | 9/2007 | Johnson |
| 7,419,145 | B2 | 9/2008 | Lee et al. |
| 2003/0068203 | A1 | 4/2003 | Khachaturian |
| 2003/0099413 | A1 | 5/2003 | Lee et al. |
| 2003/0223659 | A1 | 12/2003 | Lee et al. |
| 2004/0131287 | A1 | 7/2004 | Lee et al. |
| 2005/0100253 | A1 | 5/2005 | Chang et al. |
| 2006/0174555 | A1 | 8/2006 | Zayas et al. |
| 2006/0193542 | A1 | 8/2006 | Bradford et al. |
| 2006/0260221 | A1 | 11/2006 | Kemeny |
| 2007/0044395 | A1 | 3/2007 | Lu et al. |
| 2007/0220815 | A1 | 9/2007 | Kemeny |
| 2007/0261323 | A1 | 11/2007 | Hubbard et al. |
| 2007/0283635 | A1 | 12/2007 | Lee et al. |
| 2009/0016822 | A1 * | 1/2009 | Maher et al. ..... 405/205 |
| 2009/0064798 | A1 | 3/2009 | Xia |

FOREIGN PATENT DOCUMENTS

| | | |
|---|---|---|
| JP | 11-280024 | 10/1999 |
| JP | 2000-249189 | 9/2000 |
| WO | WO 98/58129 | 12/1998 |

OTHER PUBLICATIONS

Khurana, S. (1998), "Patents protect deepwater platform concepts", *Oil and Gas Journal* Jun. 22, 1998.

Naeim, F., et al. (1999), "Design of Seismic Isolated Structures, From Theory to Practice", John Wiley & Sons.

Maus, et al. (1986), "Platform Report—Exxon Study shows Compliant Piled Tower cost benefits", *Ocean Industry*, March.

McNulty, A.J.W, et al. (2002), "New developments in the Design of Concrete Gravity Substructures", *Proceedings of Offshore Technology Conference*, Houston, TX, OTC 14189.

Will, S.A., (1999), "Design of the Baldpate Compliant Tower", *Proceedings of Offshore Technology Conference*, Houston, TX, OTC 10915.

Will, S.A., et al. (2006), "Benguela-Belize Compliant Piled Tower: Tower Design," *Proceedings of Offshore Technology Conference*, Houston, TX, OTC 18068.

PCT/US2011/035712, International Search Report, dated Aug. 18, 2011.

English (machine) translation of JP 62-165353 Abstract, 1 page.

English translation of JP 11-280024, 6 pages.

English translation of JP 2000-249189, 8 pages.

* cited by examiner

COMPLIANT DECK TOWER

CROSS-REFERENCE TO RELATED APPLICATION

This application is the National Stage of International Application No. PCT/US2011/035712, filed 9 May 2011, which claims the benefit of U.S. Provisional Patent Application 61/359,923 filed Jun. 30, 2010 entitled COMPLIANT DECK TOWER, the entireties of which are incorporated by reference herein.

FIELD OF THE INVENTION

The disclosure herein relates generally to compliant tower platforms for offshore drilling and production of mineral resources.

BACKGROUND

This section is intended to introduce various aspects of the art, which may be associated with exemplary embodiments of the present disclosure. This discussion is intended to provide a framework to facilitate a better understanding of particular aspects of the disclosure. Accordingly, it should be understood that this section should be read in this light, and not as admissions of prior art.

Offshore oil and gas production has been conducted from platforms secured to the ocean bottom for many years. In designing such platforms, engineers must understand the environmental forces that result both from offshore winds, waves, and currents, and from earthquakes. The wind, wave, and current storm condition that engineers consider in designing an offshore platform generally involves surface wave energy with a period in the nine to sixteen second range. On the other hand, earthquakes generally involve energy with a period in a range from zero to two seconds. To the extent possible therefore, engineers design offshore platforms with frequency responses outside of these two period ranges. This design focus of the engineering community can be referred to as "isolation," or "detuning," of the platform's response from environmental excitation.

Among the types of platforms that have been used in the offshore industry are Steel Piled Jackets (SPJs) and Compliant Towers (CTs). SPJs differ from CTs in the manner of the detuning of environmental energy from the response of the platform. The SPJ, a rigidly-designed structure, typically has a natural period in the approximate range of two to four seconds—substantially below the principal range of storm energy but above the range of earthquake energy. On the other hand, CTs, which are flexibly-designed structures, have a natural period in the approximate range of twenty to thirty seconds—substantially above the principal range of both storm energy and earthquake energy. Generally, SPJs are economically viable structures in water depths less than approximately 1,000 feet, whereas CTs are economically viable structures in water depths greater than approximately 1,000 feet.

The surface facilities of offshore platforms, referred to generally as the topsides or as the decks, are also subject to earthquake energy effects. In particular, the surface facilities of SPJs are subject to earthquake energy effects due to 1) the close relationship between the natural period of SPJs and the period range of earthquake energy; 2) the two part energy amplification to which such SPJ surface facilities are subjected, first via the propagation of the motion through the soil column system and second, through the interaction of the soil system with the SPJ structure; and 3) the further amplification of equipment response through surface facility module vibration. For all these reasons, among others, engineers continually search for mechanisms to isolate surface facilities from earthquake energy.

The earthquake excitation challenge has been previously addressed via methods of isolating the deck from the lower substructure of the SPJ. For example, the paper "Structural platform solution for seismic arctic environments—Sakhalin II offshore facilities", Clarke, Buchanan, Efthymiou and Shaw, *Proceedings of Offshore Technology Conference*, Houston, Tex., OTC 17378 (2005), proposes the use of a friction bearing to dynamically isolate the deck of a gravity-based concrete structure. However, the friction bearings depend on vertical load and hence vertical acceleration for effectiveness. This dependence may result in deck uplift, with a consequent risk of toppling or shearing of the deck due to excessive horizontal and vertical accelerations. In addition, surface friction deterioration of the bearings in the marine environment generally requires continuous monitoring and maintenance.

CTs are less significantly influenced by earthquake excitation, due to the nature of their design. CTs yield to excitation energy by oscillating around a bottom underwater section (or base) in a controlled inverted pendulum manner. This oscillation creates an inertial restoring force which opposes the applied forces. That restoring force may also be augmented using one or more alternatives such as guy lines, buoyancy tanks and pile assemblies. See, for example, U.S. Pat. Nos. 4,610,569-A, 4,696,601-A, and 4,696,603-A.

The earthquake-compliant offshore platform disclosed in WO/1998/058129-A is a substantially vertical, space-frame structure extending upwardly from the floor of the body of water to a point located above the surface of the body of water. The platform has foundation means for attaching the space-frame structure to the floor of the body of water and a deck structure attached to the upper end of the space-frame structure. The natural vibration period of the platform is designed to be greater than the primary excitation period of earthquake energy and less than the primary period of storm energy. As noted above, however, such designs are generally only economically feasible in relatively deep water, typically greater than approximately one thousand feet.

The foregoing discussion of need in the art is intended to be representative rather than exhaustive. There remains a need for improved ways of decoupling or isolating the deck of offshore platforms from the energy which results from earthquakes.

SUMMARY

The present disclosure relates to a compliant deck tower comprising a working deck structure and at least one articulated leg, where the attachment point between the deck structure and each leg is flexible but stabilized, or stiffened, against rotational movement. Embodiments may for example employ universal joints or structural flex joints at the attachment points. The stabilization against rotational moment provides a restoration couple sufficient to establish a natural vibration period greater than the peak period range of earthquake energy but less than that of storm energy.

Embodiments of the present disclosure may also involve use of a sub-structure attached to the at least one leg and affixed to or partially submerged in the floor of a body of water. The contact points between the legs and the sub-structure may be by slender beams fixed within or upon said sub-structure. Such slender beams allow the attachment points to be flexible but stabilized, or stiffened, against rotational movement.

In a further embodiment, the compliant deck tower comprises a deck structure, two or more platform legs extending from the deck structure to the sea bottom, or to one or more base structures affixed on or within the sea bottom, and a plurality of isolation bearings supporting said deck structure on said platform legs. In this embodiment, a portion of the deck structure may extend below the horizontal plane of the contact points between the bearings and the deck structure.

The foregoing has outlined rather broadly the features and technical advantages of the present disclosure in order that the detailed description that follows may be better understood. Additional features and advantages will be described hereinafter which form the subject of the claims of the disclosure. It should be appreciated by those skilled in the art that the conception and specific embodiments disclosed may be readily utilized as a basis for modifying or designing other structures for implementing the purposes of the disclosure. It should also be realized by those skilled in the art that such equivalent constructions do not depart from the spirit and scope of the disclosure as set forth in the appended claims. The novel features which are believed to be characteristic of the disclosure, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

While the present disclosure is susceptible to various modifications and alternative forms, specific exemplary implementations thereof have been shown in the drawings and are herein described in detail. It should be understood that the description herein of specific exemplary implementations is not intended to limit the disclosure to the particular forms disclosed herein. This disclosure is to cover all modifications and equivalents as defined by the appended claims. It should also be understood that the drawings are not necessarily to scale, emphasis instead being placed upon clearly illustrating principles of exemplary embodiments of the present disclosure. Moreover, certain dimensions may be exaggerated to help visually convey such principles. Further where considered appropriate, reference numerals may be repeated among the drawings to indicate corresponding or analogous elements. The present disclosure and its advantages will therefore be better understood by referring to the attached drawings in which:

Figure 1A:
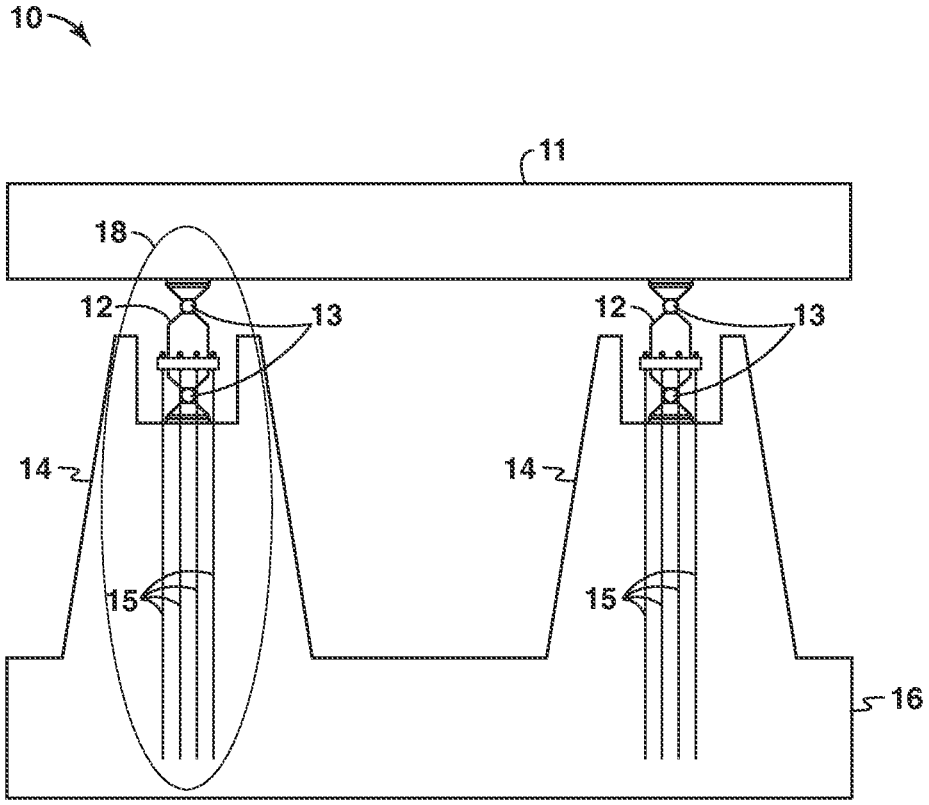
FIG. 1A is a representation of an embodiment of a compliant deck tower.

To the extent that the following detailed description is specific to a particular embodiment, however, this is intended to be illustrative only, and is not to be construed as limiting the scope of the disclosure.

DETAILED DESCRIPTION

Nomenclature and Notation

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, as understood by one of ordinary skill in the art, but the definitions are nonetheless specified here for clarity.

Battered support member: The term "battered support member" refers to the substructure of a platform in which the support members are designed to have an inclination angle relative to the seafloor that is not substantially vertical. Platforms with battered support members may otherwise be substantially similar to steel piled jackets, or may be, for example, gravity based structures.

Compliant tower: The term "compliant tower" refers to platforms which are flexibly designed to sustain significant lateral deflections and forces in response to environmental loads. Compliant towers are typically attached to the seafloor by a piled foundation in a manner similar to that described below for steel piled jackets.

Deck: The term "deck," or "deck structure," is used in the broad sense to mean the portion of an offshore platform that supports surface facilities and equipment above a water surface.

Gravity-based structure: The term "gravity-based structure" or "GBS" means a structure designed to remain on location primarily or only because the weight of the structure imposes sufficient loading on the seabed to render the structure safe from sliding or overturning. In some embodiments, a GBS may include caissons or other additional devices configured to provide additional means of securing the GBS to the seafloor, but will generally exclude the use of piles.

Platform: The term "platform" or "offshore platform" refers to the family of structures used in the oil and gas industry to develop and produce oil and gas from offshore fields. Platforms are generally bottom-founded structures, as opposed to floating structures.

Steel piled jacket ("SPJ"): The term "steel piled jacket," or "SPJ," is a type of platform designed to support substantial vertical load and to be resistant to lateral forces and moments resulting from environmental loads. The "jacket," also referred to as the "substructure," of the platform, is typically a space-frame structure fabricated from welded steel pipes with legs that are substantially vertically attached to the sea floor with steel piles. The steel piles are thick steel pipes which are driven either through jacket legs or through pile guides on the outer members of the jacket legs and penetrate into the sea bed.

Substructure: The term "substructure" refers to the portion of an offshore platform that extends from the seafloor, or optionally a base module placed on the seafloor, to the deck. The term "stiff substructure" refers to a substructure that is intended to resist, and not be compliant in response to, environmental forces. The term stiff substructure may for example be used in discussions related to steel piled jackets or gravity based structures.

Universal joint. The term "universal joint, " and the similar terms, "U joint," "Cardan joint," "Hardy-Spicer joint," and "Hooke's joint" is a joint in a rigid rod that allows the rod to 'bend' in any direction and that is commonly used in shafts that transmit rotary motion. It may consist, for example, of a pair of hinges located close together, oriented at 90° to each other, connected by a cross shaft.

Description

Reference will now be made to exemplary embodiments and implementations. Alterations and further modifications of the inventive features described herein and additional applications of the principles of the disclosure as described herein, such as would occur to one skilled in the relevant art having possession of this disclosure, are to be considered within the scope of the disclosure. Further, before particular embodiments of the present disclosure are disclosed and described, it is to be understood that this disclosure is not limited to the particular process and materials disclosed herein as such may vary to some degree. Moreover, in the event that a particular aspect or feature is described in connection with a particular embodiment, such aspects and features may be found and/or implemented with other embodiments of the present disclosure where appropriate. Specific language may be used herein to describe the exemplary embodiments and implementations. It will nevertheless be understood that such descriptions, which may be specific to one or more embodiments or implementations, are intended to be illustrative only and for the purpose of describing one or more exemplary embodiments. Accordingly, no limitation of the scope of the disclosure is thereby intended, as the scope of the present disclosure will be defined only by the appended claims and equivalents thereof In the interest of clarity, not all features of an actual implementation are described in this disclosure. For example, some well-known features, principles, or concepts, are not described in detail to avoid obscuring the disclosure. It will be appreciated that in the development of any actual embodiment or implementation, numerous implementation-specific decisions may be made to achieve the developers' specific goals, such as compliance with system-related and business-related constraints, which will vary from one implementation to another. For example, the specific details of an appropriate computing system for implementing methods of the present disclosure may vary from one implementation to another. Moreover, it will be appreciated that such a development effort might be complex and time-consuming, but would nevertheless be a routine undertaking for those of ordinary skill in the art having the benefit of the present disclosure.

Conceptually, but without limitation, embodiments of the present disclosure isolate the deck of an offshore platform from energy which would otherwise be transferred to the deck from the substructure-soil system. The energy isolation results from the inverted pendulum compliant nature of the platform. The deck of the platform acts as the pendulum mass. The legs of the platform act as the pendulum string, via connections to both the deck and the substructure, with contact points at the top of the legs that permit swiveling in the horizontal direction, thus permitting deck motion. The restoring force for the pendulum is provided by structural elements that constrain the deck motion. Embodiments of the present disclosure may also use supplemental damping devices to augment the damping of the constraining structural elements.

The natural period of vibration of the inverted pendulum is a function of the deck's mass and elevation above the substructure, and the amount of rotational constraint provided by the structural elements. For a given deck mass, the deck's natural period can be moved away from, which may also be referred to as detuned from, the dominant period of the substructure-soil system by adjusting either or both of the deck height and the stiffness of the rotational constraints. For a compliant deck with four supporting legs and a uniformly distributed mass, the generalized equation representing this relationship is $T=2\ [\{m\ (H*H+d*H/2)/4\ K_r\}]^{1/2}$, where T=natural period, m=mass of the deck, H=elevation of the deck bottom from the top of the substructure leg, d=height (or depth) of the deck from the deck bottom to the deck surface, and $K_r$=required rotational resistance per deck leg. For example, for a compliant deck tower with m=33,600 tons (30,000 metric tons), H=16.4 ft. (5 m), d=49.2 ft (15 m), and a target period of T=5 seconds, the required restoration moment $K_r$=545,796 kips·ft/rad (740 MNm/rad).

FIG. 1A schematically illustrates an embodiment of a compliant deck tower 10 suitable for shallow water in arctic earthquake prone environments. Deck 11 is supported by substructure 16. This embodiment involves a stiff substructure with battered, also referred to as sloping, support members 14 which are particularly suited to arctic environments, although the use of battered support members is not a limitation of the present disclosure. As illustrated in this embodiment, articulated, rigid support legs 12, for example fabricated using a hardened steel alloy material, are attached to deck 11, and to support members 14 of substructure 16, through universal joints 13. As is further described below, other energy isolation connections may be employed as alternates for universal joints 13 and remain fully within the scope of this disclosure and as will be known to those skilled in the art. Slender beams 15 are affixed both to support members 14 and to legs 12. The point of connection or fixity of beams 15 to support members 14 can be at any point below universal joints 13 sufficient to create a restoring force. Slender beams 15 are typically affixed to support legs 12 at a plurality of points, preferably including at least one point within the lower third of the height of a support leg 12. Construction of offshore towers is well known in the industry, and, as will also be well known, elements 11-16 are typically prefabricated independently, or in readily constructed and/or transported combinations, and then floated or carried to the site of installation for final completion.

Although the deck's period is selected principally to achieve horizontal isolation, some degree of vertical isolation results from energy dissipation via the coupling of the horizontal and vertical motions through the deck's motion. Furthermore, the compliant deck tower's nature has the potential of decoupling the deck from such forces as ice load vibration and wave loading.

Embodiments of the present disclosure, such as depicted in FIG. 1A, overcome several shortcomings of prior art SPJs. For example, both deck leg uplift, which is also referred to as unseating, due to excessive vertical acceleration, and toppling, also referred to as shearing, due to horizontal momentum can occur in prior art structures. Embodiments of the present disclosure involve legs that are structurally attached to both the deck above and the substructure below, through the combination of universal joints and rigid support members, thus minimizing or eliminating substantial deck lift.

In addition, as noted above, some prior art structures depend on vertical load, and hence vertical acceleration, to isolate the horizontal stiffness that provides much of the detuning sought. In embodiments of the present disclosure, the restoring force is provided via axial or bending stiffness of structural elements, or both, and hence is substantially independent of vertical loads and accelerations.

Deterioration of deck-leg isolating structures can often occur at or near the surface of the body of water, for example by exposure to waves when the weather or surface friction deteriorates the exposed surfaces. Universal joints act with minimal surface friction, thus minimizing the impact such deterioration may have on overall system performance.

Figure 1B:
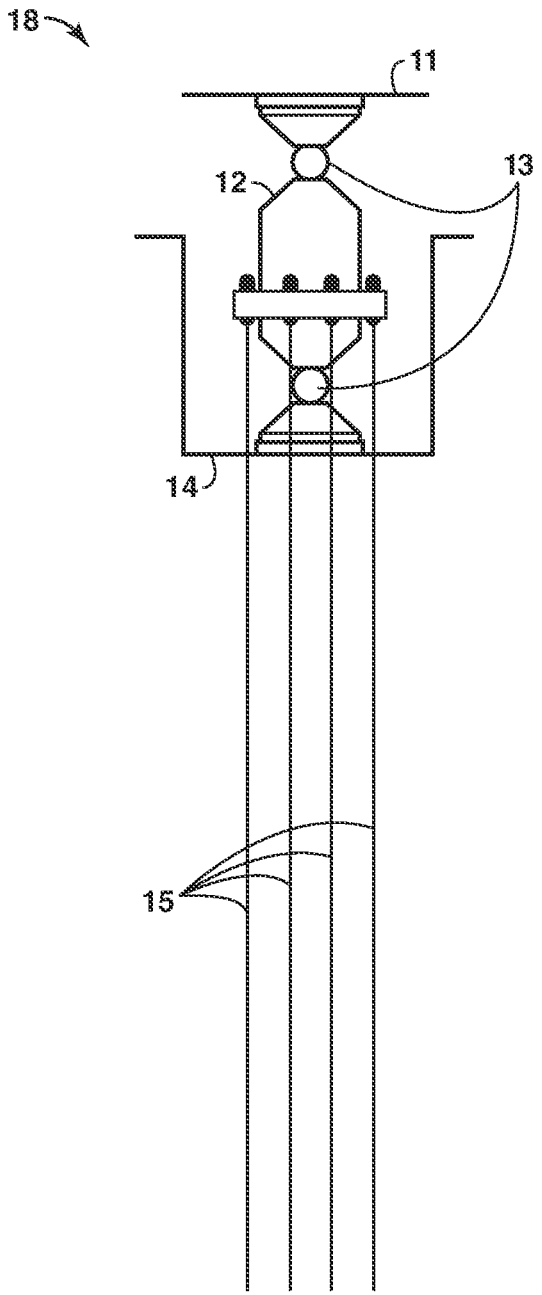
FIG. 1B is a representation of an embodiment of a rotationally constrained universal joint connection of a deck to the substructure of a compliant deck tower.

As noted above, and further exemplified by section 18 in FIG. 1A, which is shown in expanded view in FIG. 1B, universal joints 13 are used to attach articulated, rigid support legs 12 to deck 11, and to attach support legs 12 to support members 14. Universal joints 13 allow swiveling around any horizontal axis, but can resist torque around the vertical axis of the deck legs. As exemplified in FIG. 1B, slender beams 15 are fixed within or upon said support legs 12 at a point such that a restoration coupling moment is established for effective stabilizing and stiffening of deck 11. Supplemental damping can also be used to suppress deck motion via various alternative damping devices. Examples of suitable damping devices known in the art include 1) hysteretic devices using metallic yielding or mechanical friction and 2) visco-elastic devices based on use of visco-elastic solids or polymers or viscous fluids. As depicted in FIG. 1A, slender beams 15 extend through support members 14 and have a length needed to achieve the required axial stiffness and hence rotational constraint required for the design of the compliant deck tower. The lower ends of slender beams 15 are attached to or within substructure 16 by any method, such as flanges, that provides the desired axial strain in slender beams 15 that in turn results in the restoration coupling moment. The upper ends of slender beams 15 are attached, for example, by use of flanges to the circumference of support legs 12.

Universal joints, and any similarly operating U-joint, Cardan joint, Hardy-Spicer joint, or Hooke's joint, are well known in the industry and may be appropriately employed in embodiments of the present disclosure. Other connection means for achieving the energy isolation objectives of the present disclosure will be known to those skilled in the art, such as for example isolation bearings and friction dampers. See, for example, U.S. Pat. No. 7,419,145-B2.

The arrangement of the embodiment in FIG. 1A and FIG. 1B involving a rigid support leg 12 and a universal joint 13 is similar to Cardan joints used in the automotive industry, and other industries, except that the depicted arrangement (1) does not transfer torque but rather resists torque and (2) carries a significant permanent axial force, the vertical deck weight, which is transmitted to the substructure. For a deck weight range of 20,000 to 40,000 tons (18,140 to 36,290 metric tons), an embodiment of the present disclosure with four legs may have a deck permanent axial force in the range between 5,000 tons and 10,000 tons (4,540 to 9,070 metric tons).

In another embodiment of the present disclosure, the compliant deck tower makes use of structural flex joints at the top, and optionally at the bottom, of the rigid support legs 12 to provide both rotational flexibility and restoring moment. These can be placed as illustrated for the universal joints 13 in FIG. 1, but typically without the slender beams 15. The structural flex joint is a joint comprised of structural elements that permit lateral pivoting through elastic flexing or bending of certain of its structural members. See for example, U.S. Pat. No. 4,717,288-A. Preferably, the use of such structural flex joints at both the top and the bottom of support legs 12 effectively distributes the required rotational stiffness between the top and bottom of legs 12. As will be understood to those skilled in the art, flex joints provide a reduction in bending stiffness, but maintain axial, shear and torsion stiffness. Bending stiffness can be adjusted to achieve the required rotational stiffness and thus the desired detuning effect. Using a flexible material, such as aluminum or other metal alloys, in a reduced size section of leg 12 at the point of attachment to the flex joint, can be useful to achieve the rotational flexibility required in detuning the deck from earthquake vibration and shock.

A computer simulation was carried out to demonstrate the deck isolation response characteristics of the embodiment of FIG. 1. In the simulation, a platform with a deck having a weight of about 30,000 tons (27,215 metric tons) and a height of 50 ft (15.24 m), steel legs having a length from substructure attachment point to deck attachment point of 17 ft (5.18 m), and a substructure weight of 150,000 tons (136,078 metric tons), was assumed to be supported on the sea bottom with a soil-structure peak frequency response period of 1.25 sec. The simulation was carried out for the resulting deck-substructure mass ratio of 0.2 for both a rigidly connected deck and a deck-isolated platform. The deck-isolated platform was assumed to have universal joints stabilized at the sub-structure by an arrangement of slender beams that provided a stabilizing rotational stiffness of 750 mega Newton-meter per unit radian per leg, resulting in a deck frequency response period of 5 seconds, a deck-substructure period ratio of 4, and a substructure damping ratio of 0.05. Both the rigidly connected deck platform and the deck-isolated platform were modeled with the same material, weight ratios, and dimensions, differing only in the added joints for the deck-isolated platform. The results of the simulation are depicted in FIGS. 2A and 2B.

Figure 2A:
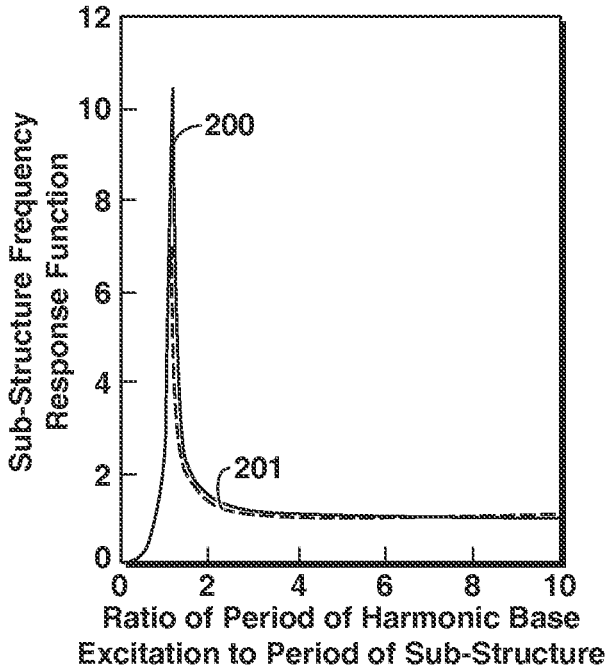
FIG. 2A depicts the frequency response function of a rigidly supported deck and its substructure.

FIG. 2A compares the substructure frequency response function (frequency response function 200) to that of the deck (frequency response function 201). Both the rigidly connected deck in FIG. 2A and the compliant deck tower embodiment in FIG. 2B have a deck-substructure mass ratio of 0.2, and, as can be seen in this figure, the frequency response function for both substructure and rigidly connected deck is substantially identical, although the peak amplitude of the deck is somewhat lower than that of the substructure.

Figure 2B:
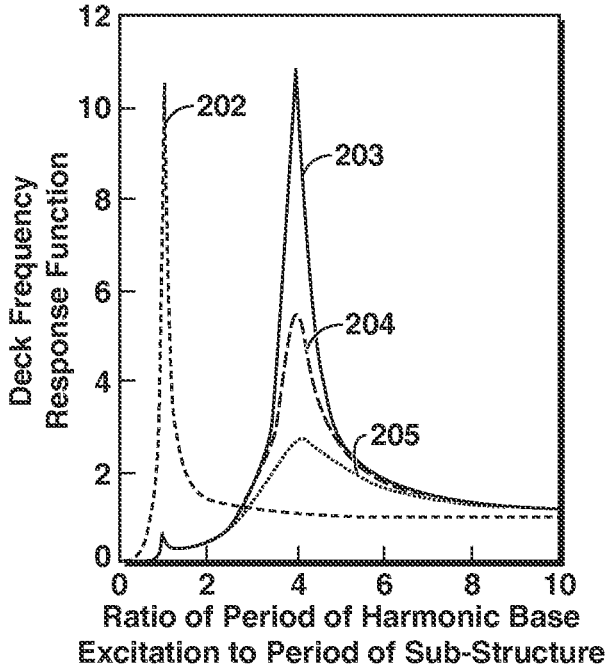
FIG. 2B depicts the substructure frequency response function of a rigidly connected deck-to-substructure tower and a compliant deck-to-substructure tower for a range of towers damping ratios.

FIG. 2B compares the frequency response function of the substructure (frequency response function 202) and that of the compliant deck tower embodiment. Both the rigidly connected deck in FIG. 2A and the compliant deck tower embodiment in FIG. 2B, have a deck-substructure mass ratio of 0.2.

As can be seen in FIG. 2B, isolation of the deck in accordance with the present disclosure shifts the peak of the deck frequency response ratio from about 1 second to about 4 seconds, thus demonstrating the energy response isolation benefit of the present disclosure. FIG. 2B also shows that deck frequency response function amplitudes are reduced for increased damping ratios, where frequency response function 203 is plotted for a damping ratio of 0.05, with damping ratios of 0.1 (curve 204) and 0.2 (curve 205) also being depicted. Thus, the amplitude of the deck response function can be lowered by additional damping in compliant deck tower embodiments.

In alternative embodiments of the present disclosure, deck isolation can be achieved by using horizontal isolation bearings that are supported at a level in proximity to the deck's vertical center of gravity so as to minimize deck overturning moment and deck uplift. For purposes of such embodiments "in proximity to" means that the bearing contact points are slightly above, at the same level, or slightly below, the vertical center of gravity of the deck structure. In an earthquake, vertical acceleration can reach one gravitational unit or higher. With such vertical acceleration, the use of isolation bearings alone could potentially result in toppling the deck—dumping the deck partially or entirely off the structure. In addition, the combination of vertical and horizontal acceleration could allow the structure to move with respect to the isolation bearings, and, in the extreme situation, to slide off the platform structure. Thus, locating a lower portion of the deck structure within a fixed support frame attached securely to the support legs, or fitted between the support legs themselves, provides additional horizontal stability.

Figure 3A:
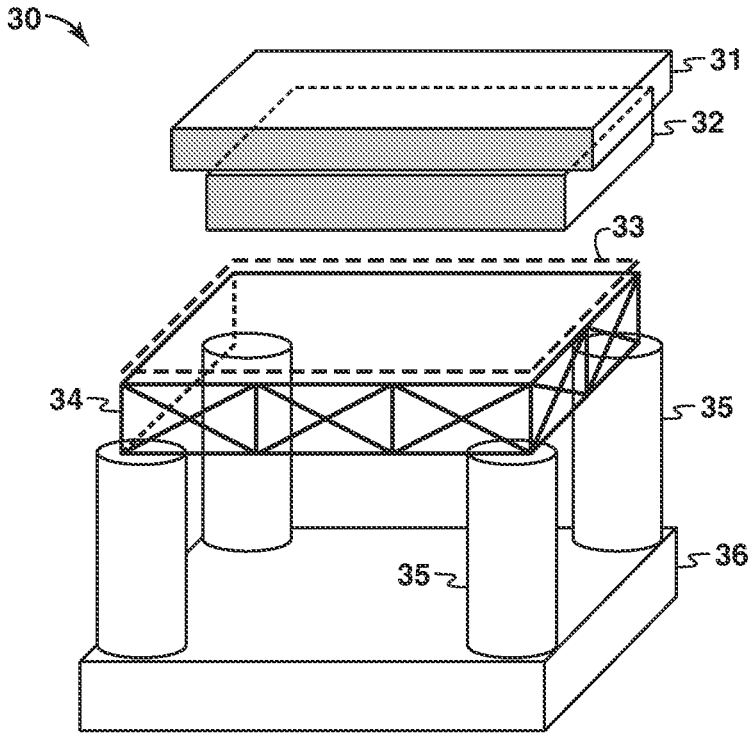
FIG. 3A illustrates a schematic view of an embodiment of a compliant deck structure in which isolation bearings support a frame mounted deck.
Figure 3B:
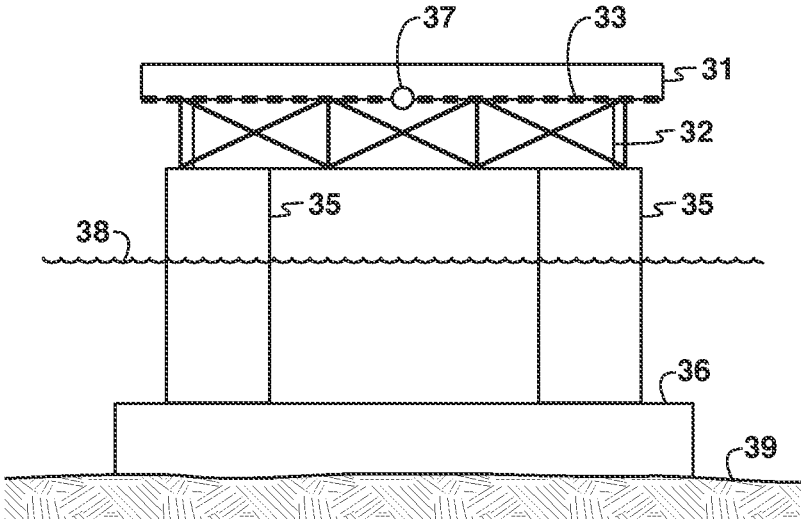
FIG. 3B illustrates the embodiment of FIG. 3A with the deck mounted in the bearing support frame.

More specifically, FIG. 3A depicts a schematic perspective view of an embodiment of an offshore structure 30 in which isolation bearings 33 support a deck 31 by being mounted on a bearing support frame 34. This frame is rigidly attached to the top of support legs 35. As indicated in FIG. 3B, lower section 32 of deck 31 is below, or as shown in this embodiment at least largely below, the horizontal plane in which the isolation bearings 33 are mounted on support frame 34. For example, lower section 32 may be below vertical center of gravity 37 of deck 31 by being designed as a recessed structure which fits inside bearing support frame 34. The bottom of support legs 35 can be affixed or mounted on a base 36, or affixed in the water bottom 39. The use of a bearing support frame 34 allows the use of bearings fully along the points of contact between bearing support frame 34 and deck 31. This in turn permits optimization of the number and size bearings for performance, cost and installation ease. The fitting of the lower section 32 of the deck 31 within the space created by frame 34, with the frame rigidly affixed to the legs, or via another superstructure attached to or a component of the legs, provides horizontal restraint by preventing the deck from sliding off the platform in the event of acceleration from earthquake shock.

Figure 4A:
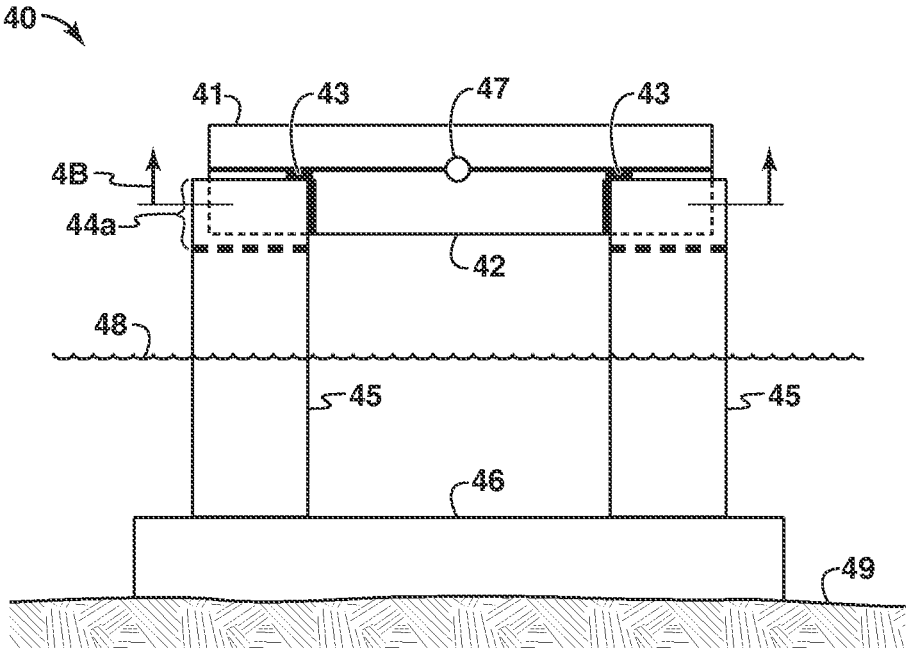
FIG. 4A illustrates the use of isolation bearings at contact points between the support legs and the deck structure of an embodiment of a compliant deck structure.

FIG. 4A shows a side view of a gravity-based offshore platform 40 that rests on a seafloor 49 in body of water having water surface 48. In platform 40, bearings 43 are placed in proximity to (as defined above) the deck vertical center of gravity 47. This can result, for example, by having isolation bearings 43 mounted on the top of support legs 45. Preferably, a lower portion 42 of the deck structure is smaller in size than the area circumscribed by the tops 44*a* of support legs 45, or recessed, so as to fit within the area bounded by the tops 44*a* of support legs 45.

Figure 4B:
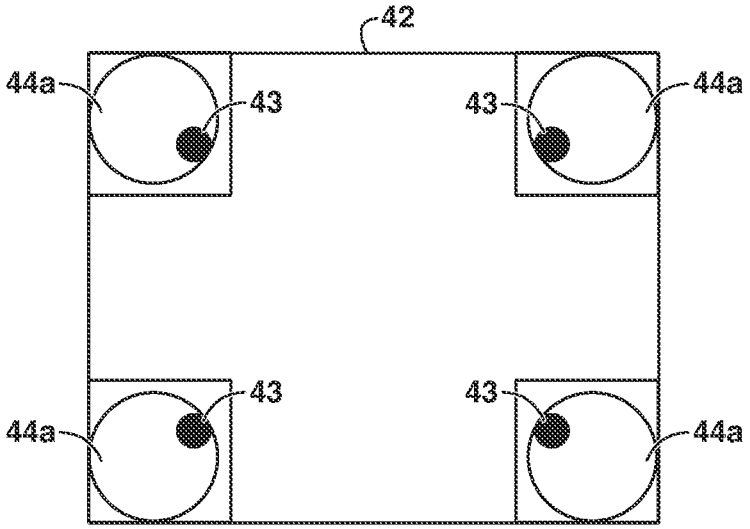
FIG. 4B illustrates the isolation bearing contact points of the embodiment of FIG. 4A.

FIG. 4B illustrates the use of isolation bearings 43 at contact points between the tops 44*a* of each support leg 45 and deck structure 41 where a horizontal line containing the isolation bearing points 43 is in proximity to the vertical center of gravity 47 of deck structure 41 and wherein the lower portion 42 of deck structure 41 is shaped to extend into the space between each set of two legs of the four leg supported platform. Thus, at least the lower section 42 of deck structure 41 is shaped to fit around the tops 44*a* of legs 45, e.g. in a squared-cross configuration for the four legs illustrated, and thus is inhibited from any sideways movement in the event of excessive vertical acceleration lifting, or partially lifting, of deck structure 41 off bearings 43. Note that the portion of lower section 42 of deck structure 41 which extends between support legs 45 may be the same width as the upper portion of deck structure 41, as depicted in FIG. 4A and FIG. 4B, or may be narrower.

Figure 5:
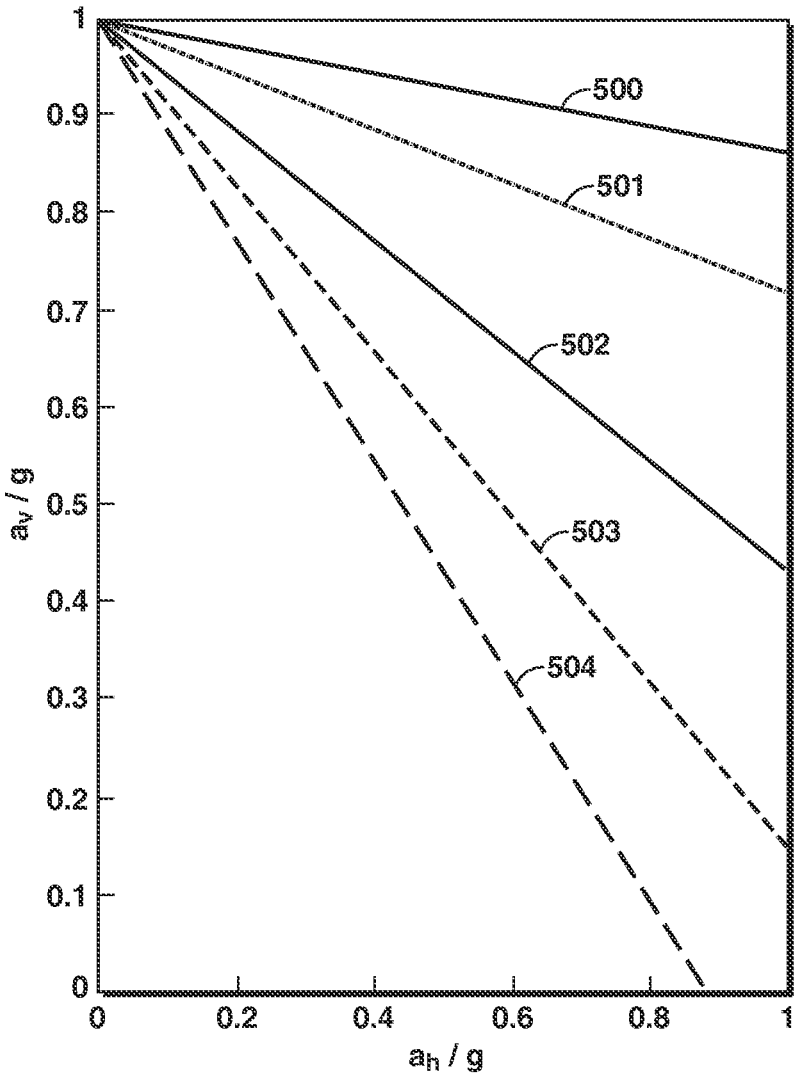
FIG. 5 depicts a normalized set of compliant deck tower response curves wherein the vertical acceleration, which is the vertical axis, is plotted against the horizontal acceleration, which is the horizontal axis, for a 4-legged compliant deck tower with a range of ratios of the height of the center of gravity to the distance between isolation bearings.

In one embodiment for a four-legged platform substantially similar to the platform depicted in FIG. 4A, the lower portion 42 of deck structure 41 is of sufficient weight to establish a vertical center of gravity 47 for said deck structure at a position that satisfies the relationship $h/L \leq 25\%$, where h=the height of the center of gravity of the deck structure 41 from the horizontal plane of the bearing contact points, and where L equals the shortest distance between two isolation bearings located on adjacent legs. In another embodiment, the lower deck portion 42 is of sufficient weight to establish a vertical center of gravity 47 for said deck structure at a position that satisfies the relationship $h/L \leq 20\%$, and in still another embodiment $h/L \leq 10\%$. FIG. 5 shows the combination of instantaneous vertical acceleration normalized to gravity $a_v/g$, plotted along the vertical axis, and the simultaneous horizontal acceleration normalized to gravity, $a_v/g$, plotted along the horizontal axis, that could lead to the uplift of the deck at one deck leg for a 4-legged prismatic deck with uniform distributed mass. The data in FIG. 5 are plotted for a range of values of the ratio h/L, as follows: h/L=0.05 (curve 500), h/L=0.1 (curve 501), h/L=0.2 (curve 502), h/L=0.3 (curve 503), and h/L=0.4 (curve 504). As will be understood to those skilled in the art, for a zero horizontal acceleration ratio, $a_h/g=0$, a vertical acceleration equal to one gravitational unit, e.g., $a_v/g=1$, is necessary to cause uplift. However, for increasing values of the ratio of h/L the upward vertical acceleration necessary to cause at least one deck leg uplift decreases in direct proportion to the simultaneous horizontal acceleration, as evidenced by the shift in curves 500 to 504. The data depicted in FIG. 5 are typical of the information that will be considered in designing platforms in accordance with the present disclosure as a function of the applicable earthquake design conditions.

While the techniques of the present disclosure may be susceptible to various modifications and alternative forms, the exemplary embodiments discussed above have been shown by way of example. It should again be understood that the disclosure is not intended to be limited to the particular embodiments disclosed herein. Indeed, the present disclosure includes all modifications, equivalents, and alternatives falling within the spirit and scope of the appended claims.

We claim:

1. A compliant deck tower for use in offshore drilling and production of natural resources comprising a deck structure and a substructure extending from the deck structure to a seafloor, wherein the substructure is connected to the deck structure by a connection which comprises at least one universal or structural flex joint that isolates the deck structure from the energy imparted onto the substructure by horizontal environmental forces and one or more structural elements configured to provide a restoring force, the one or more structural elements comprising one or more slender beams fixed within or upon the substructure.

2. The tower of claim 1, wherein the connection comprises at least one universal joint.

3. The tower of claim 1, wherein the connection comprises at least one structural flex joint.

4. The tower of claim 1, wherein the substructure extends to a base structure on the seafloor.

5. The tower of claim 1, wherein the connection that connects the substructure to the deck structure further comprises at least one articulated support leg having an attachment point to said deck structure and an attachment point to said substructure, wherein said at least one articulated support leg further comprises two universal or structural flex joints.

6. An offshore structure having a support structure and a deck supported atop the support structure, comprising: a seismic isolation structure for supporting the deck relative to the support structure so as to permit the deck and support structure to move horizontally relative to each other in response to horizontal forces of an earthquake, the deck being connected to the support structure in a manner that prevents horizontal movement of the deck relative to the support structure beyond a preselected horizontal distance, wherein the deck has a lower section positioned so as to be restrained by upper portions of the support structure to prevent lateral movement of the deck beyond the preselected horizontal distance.

7. The offshore structure of claim 6, wherein the seismic isolation structure comprises a plurality of friction bearings disposed between the deck and the support structure.

8. The offshore structure of claim 7, wherein the support structure further comprises a plurality of support legs, and wherein each of the plurality of friction bearings are disposed between the deck and the support legs.

9. The offshore structure of claim 8, wherein a lower portion of the deck interior of the support legs is located below the plurality of friction bearings.

10. The offshore structure of claim 9, wherein the lower portion of the deck has a squared-cross configuration configured to fit between the support legs.

11. An offshore structure having a support structure and a deck supported atop the support structure, comprising: a seismic isolation structure for supporting the deck relative to the support structure so as to permit the deck and support structure to move horizontally relative to each other in response to horizontal forces of an earthquake, said deck being connected to the support structure in a manner that prevents horizontal movement of the deck relative to the support structure beyond a preselected horizontal distance, wherein the seismic isolation structure is adapted to support the deck and is further adapted to permit the deck to laterally pivot relative to the support structure in response to horizontal forces of an earthquake, said seismic isolation structure having a means for applying a vertical couple to said deck which tends to resist horizontal movement of the deck relative to the support structure.

12. A compliant deck tower for use in offshore drilling and production of natural resources comprising a deck structure and a substructure extending from the deck structure to a seafloor, wherein the substructure is connected to the deck structure by a connection which comprises a plurality of bearings located on a generally horizontal plane and mounted on a bearing support frame located between the deck structure and the substructure, the connection isolating the deck structure from the energy imparted onto the substructure by horizontal environmental forces, wherein a lower portion of the deck structure interior of the bearing support frame is located below the plurality of bearings.

13. The tower of claim 12, wherein the plurality of bearings are mounted fully along the points of contact between the bearing support frame and the deck structure.

14. An offshore structure having a support structure and a deck supported atop the support structure, comprising: a seismic isolation structure comprising a plurality of friction bearings disposed between the deck and the support structure for supporting the deck relative to the support structure and to permit the deck and support structure to move horizontally relative to each other in response to horizontal forces of an earthquake, the deck having a lower section positioned interior of the support structure and located below the plurality of friction bearings to prevent lateral movement of the deck beyond a preselected horizontal distance.

15. The offshore structure of claim 14, wherein the support structure comprises a plurality of support legs and the plurality of friction bearings are disposed between the deck and the support legs, and wherein the lower portion of the deck has a squared-cross configuration configured to fit between the support legs of the support structure.

16. An offshore structure having a support structure and a deck supported atop the support structure, comprising: a seismic isolation structure comprising a plurality of friction bearings disposed between the deck and the support structure for supporting the deck relative to the support structure and to permit the deck and support structure to move horizontally relative to each other in response to horizontal forces of an earthquake, the deck having a lower section positioned interior of the support structure and located below the plurality of friction bearings to prevent lateral movement of the deck beyond a preselected horizontal distance, wherein the support structure comprises a plurality of support legs and the plurality of friction bearings are disposed between the deck and the support legs, and wherein the lower portion of the deck has a squared-cross configuration configured to fit between the support legs of the support structure.

* * * * *